United States Patent [19]

Stultz

[11] Patent Number: 4,820,906

[45] Date of Patent: Apr. 11, 1989

[54] LONG ARC LAMP FOR SEMICONDUCTOR HEATING

[75] Inventor: Timothy J. Stultz, San Jose, Calif.

[73] Assignee: Peak Systems, Inc., Fremont, Calif.

[21] Appl. No.: 25,306

[22] Filed: Mar. 13, 1987

[51] Int. Cl.[4] ..... H05B 31/24

[52] U.S. Cl. ..... 219/405; 219/354; 219/347; 219/343

[58] Field of Search ..... 219/405,411, 354, 347, 219/349, 343; 313/113, 634, 623, 643, 620; 250/492.2; 118/724, 725, 50.1; 148/1.5

[56] References Cited

U.S. PATENT DOCUMENTS

| | | | |
|---|---|---|---|
| 2,134,474 | 10/1938 | Gillespie | 219/405 |
| 2,965,790 | 12/1960 | Ittig | 313/643 |
| 3,029,359 | 4/1962 | White | 313/634 |
| 3,484,639 | 12/1969 | Jansen | 313/623 |
| 3,892,993 | 7/1975 | Timmermans | 313/623 |
| 4,503,356 | 3/1985 | Kobayashi | 313/634 |
| 4,527,097 | 7/1985 | van der Heijden | 313/634 |
| 4,550,684 | 11/1985 | Mahawili | 219/343 |

FOREIGN PATENT DOCUMENTS

| | | | |
|---|---|---|---|
| 282464 | 12/1927 | United Kingdom | 219/347 |

OTHER PUBLICATIONS

Reinhold, Hermann D., "Neue Bauelemente . . . ", Klepzig Fachberichte (Germany), vol. 79, Apr. 1971, No. 4, pp. 207–211.

*Primary Examiner*—Teresa J. Walberg
*Attorney, Agent, or Firm*—Townsend & Townsend

[57] ABSTRACT

A long arc gas-discharge lamp for rapidly heating a semiconductor wafer. The spectral output of the lamp is specifically matched to the absorption characteristics of the particular semiconductor wafer being heating by choosing an appropriate gas or mixture of gases. The electrodes of the long arc lamp are separated by a distance greater than the largest dimension of the semiconductor wafer to insure that the entire wafer is illuminated at one time. In addition, the lamp has a high power density to raise the temperature of the semiconductor wafer to the required process temperature. Large diameter metal electrodes are used to conduct more heat from the ends of the lamp. The electrodes contain a low work function metal such as thorium oxide to increase the electron emission. The enclosing glass capillary has thin walls between the electrodes for improved heat dissipation. The glass capillary is cooled to carry the heat away from the lamp.

4 Claims, 2 Drawing Sheets

LONG ARC LAMP FOR SEMICONDUCTOR HEATING

BACKGROUND

The present invention relates to arc lamps used to heat semiconductor wafers in semiconductor processing.

Advances in processing of integrated circuit devices, in particular, devices of decreased dimensions, have necessitated the development of new processing and manufacturing techniques. One of the strictest requirements imposed by the tight tolerances on the dimensions of such devices has been the need to restrict the amount of time an integrated circuit device is subjected to high temperatures. This has lead to the development of a rapid thermal process step, whereby the semiconductor device is irradiated with an optical or incandescent source powerful enough to quickly raise the temperature of the semiconductor device to the desired process temperature and hold it at that temperature for a sufficient time to accomplish a specific process step.

Early demonstrations of rapid thermal processing were accomplished with lasers. From a manufacturing standpoint, however, lasers have the disadvantage of high cost, low efficiency, small process areas and the need to raster or step the laser beam across the work surface with the result being a nonuniform step coverage. Since the rapid thermal heating process step does not require coherent radiation, other practitioners of the art have used incandescent heat sources, either glowing carbon strips or tungsten-halogen lamps. These heat sources have the disadvantage that their spectral output is a function of the source temperature. As more power is applied to the lamp (or carbon strip) to raise the temperature of the semiconductor device, the spectral content of the radiation changes and, therefore, the amount of energy absorbed in the semiconductor is a non-linear function of the power. In addition, at low input power, most of the energy from the incandescent lamps and carbon strips is at long wavelengths where semiconductors such as silicon or gallium arsenide appear transparent and can absorb little of the radiation.

One method used for heating semiconductors which allows low power operation of a continuous wave arc lamp is shown in U.S. Pat. No. 4,356,384 to Gat. The Gat apparatus moves the arc lamp across the semiconductor wafer so that only a small portion of the wafer is exposed to the light at any one time, thereby eliminating the need for the entire wafer to be illuminated at once and thus allowing a lower power lamp to be used. The technique also requires the use of a preheater to prevent damage to the semiconductor resulting from the large thermal gradients induced by the moving source.

U.S. Pat. No. 4,097,762 to Hilton shows a particular electrode composition wherein the arc discharge is obtained without heating the electrode. The electrode uses oxides of barium, calcium and aluminum.

U.S. Pat. No. 4,184,065 to Nagashima shows an ellipsoidal reflecting mirror for aiding in the heating of a wafer. By using the mirror to direct light already emitted from the lamp back onto the wafer, additional illumination and heating of the wafer is obtained without requiring more power to be applied to the lamp.

SUMMARY OF THE INVENTION

The present invention is an improved long arc gas-discharge lamp for rapidly heating a semiconductor wafer. The spectral output of the lamp is specifically matched to the absorption characteristics of the particular semiconductor wafer being heated by choosing an appropriate gas or mixture of gases.

Preferably, the electrodes of the long arc lamp are separated by a distance greater than the largest dimension of the semiconductor wafer to insure that the entire wafer is illuminated at one time. In addition, the lamp must be able to achieve a high enough power density to raise the entire semiconductor wafer to the required process temperature. This is accomplished by a combination of features. Large diameter metal electrodes are used to conduct more heat from the ends of the lamp. The electrodes contain a low work function metal such as thorium oxide to increase the electron emission. The enclosing glass capillary has thin walls in between the electrodes for improved heat dissipation. This glass capillary is water cooled to carry the heat away from the lamp.

In addition, uniform heating of the semiconductor wafer is achieved by a specially shaped reflector which produces multiple lamp images of the single lamp for uniform illumination. The preferred shape of the reflector has a radius of curvature immediately above the lamp of less than the distance from the reflector to the lamp. This radius of curvature extends for a region of approximately 30° from the lamp on either side of a vertical line extending to the lamp. The remainder of the reflector has a radius of curvature of approximately twice the distance from the reflector to the center of the semiconductor wafer being heated.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
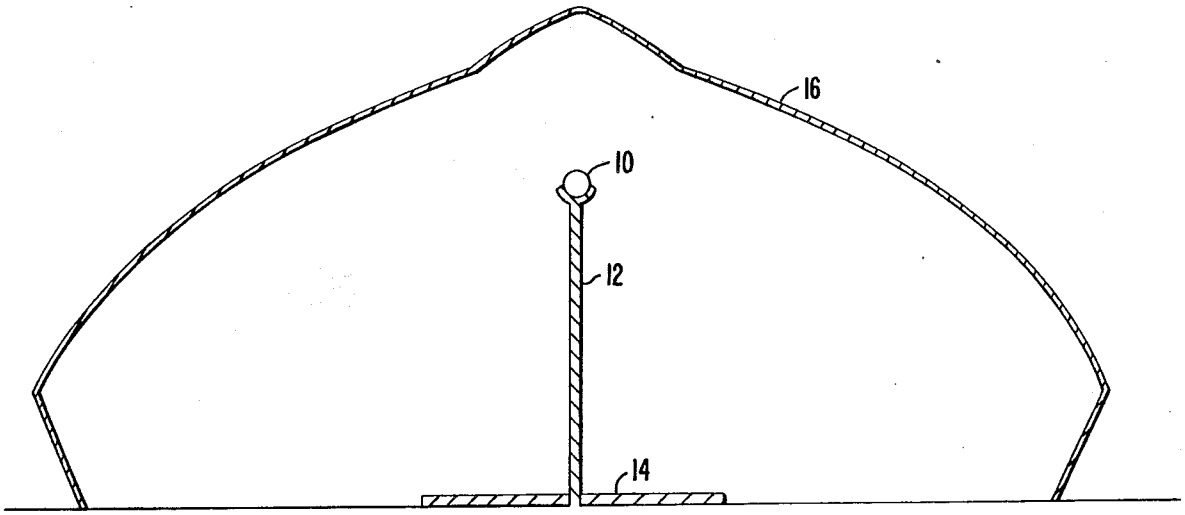
FIG. 1 is an end view of a heating apparatus according to the present invention showing the shape of the reflector.

FIG. 1 shows a heating apparatus for semiconductor wafers according to the present invention. An arc lamp 10, shown from the end, is supported by a support structure 12 above a semiconductor wafer 14. A reflector 16 is designed to reflect light from arc lamp 10 back onto wafer 14, as well as reflecting light reflected off wafer 14 and emitted by water 14.

Figure 2:
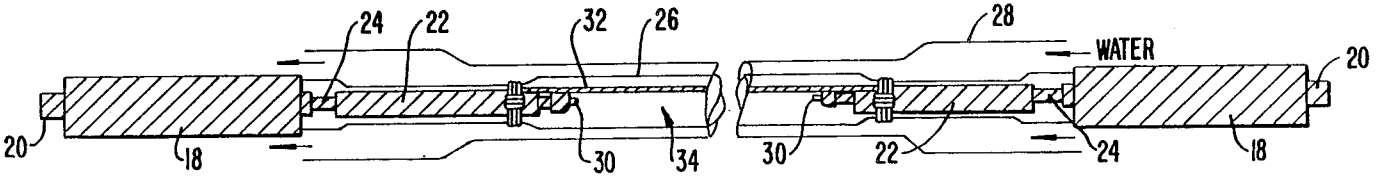
FIG. 2 is a side view of a long arc lamp according to the present invention.

FIG. 2 is a side view of arc lamp 10 of FIG. 1. A pair of end supports 18 with terminals 20 are coupled to a pair of longitudinally spaced electrodes 22 by a pair of members 24. Supports 18 and members 24 are electrically conductive, and are preferably made of thoriated tungsten. The electrodes are enclosed by a transparent quartz capillary 26. A transparent water jacket 28 surrounds quartz capillary 26 and provides water cooling with water flowing through jacket 28 in the direction indicated by the arrows.

In operation, upon applying current to terminals 20, an arc is generated between tips 30 of electrodes 22. A wire 32 is provided on the outside of the quartz capillary to provide a floating shunt upon starting of the lamp in a known manner. The interior of quartz capillary 26 is filled with a gas or mixture of gases 34. The gas is chosen to have a spectral output which matches the absorption characteristics of semiconductor wafer 14 of FIG. 1.

Figure 3A:
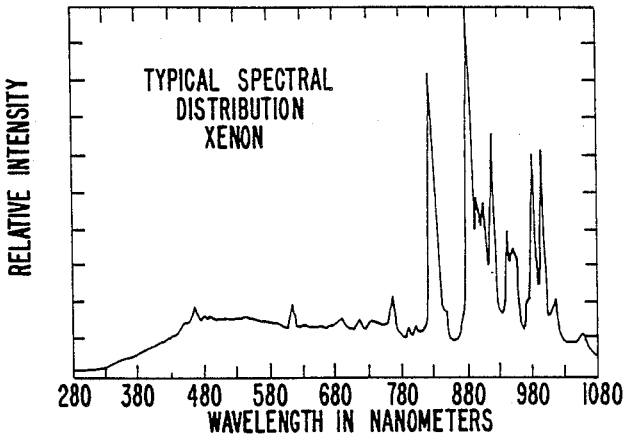
FIGS. 3A, 3B and 3C are diagrams of the spectral emission distributions of xenon, mercury and krypton lamps, respectfully.
Figure 3B:
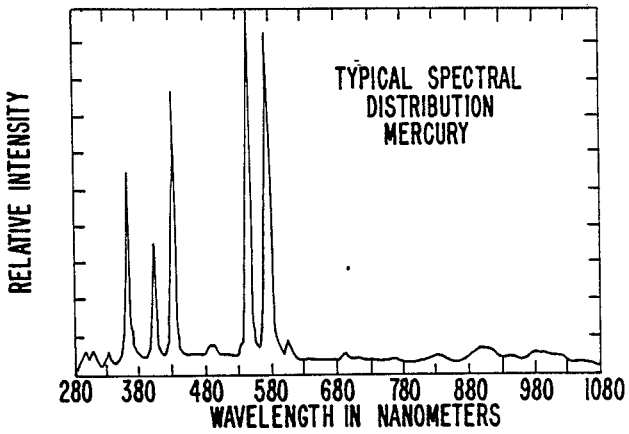
Figure 3C:
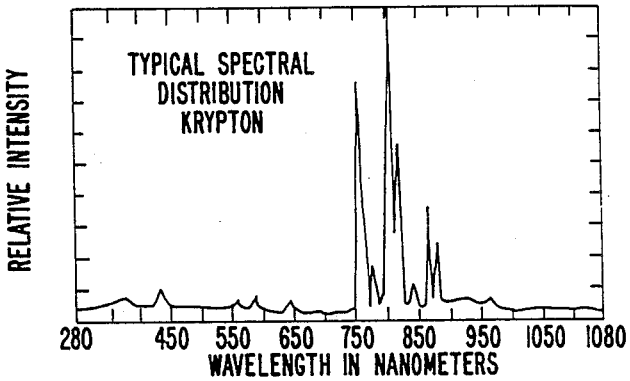

The spectral output of the lamp is a function of the gas used to create the gas discharge illumination. FIGS. 3A, 3B and 3C show the spectral distributions for xenon, mercury and krypton, respectively. The type of gas or combination of gases is chosen so that the spectral output produces a light emission having a wavelength with an energy greater than the energy band gap of the semiconductor wafer.

The band gap energy is the energy needed for an electron to pass from the valence band of the semiconductor to the conduction band. This is essentially the amount of energy needed to break the electrons away from their parent atoms or groups of atoms so that they are free to move through the crystal of the wafer and take part in electrical conduction. The movement of the electrons from the valence band to the conduction band absorbs optical energy. The electrons then give up the energy to the semiconductor lattice in the form of thermal energy which heats the semiconductor wafer. Light which has insufficient energy to cause an electron to jump the band gap between the valence and conduction bands will produce no heat of this type (Some heat will be produced by free carrier absorption, but this is temperature dependent, thus making precise control difficult). Accordingly, any portion of the spectral output of the lamp which has an energy lower than the band gap will be substantially wasted and will not produce heat in the semiconductor wafer. Accordingly, the present invention matches a gas which has its maximum spectral output at energies above the band gap energy of the semiconductor wafer. For instance, the maximum spectral distribution of xenon occurs at wavelengths between approximately 800 and 1,000 nanometers. Xenon is suited for silicon semiconductors which have an energy gap of 1.1 electron volts (eV) or gallium arsenide, which has an energy gap of 1.4 eV.

Other gases can be used depending upon the particular application. For example, the mercury lamp, which has a much larger component of its illumination intensity near the ultraviolet (UV) range is better suited for heating thin films on a transparent substrate, such as quartz or sapphire.

By using a gas discharge mechanism rather than a filament heating method as in the prior art, the spectral distribution of the lamp does not vary with power and thus will be matched to the absorption characteristics of the semiconductor regardless of the power applied to the lamp. The lamp of the present invention is also not sensitive to the level of doping of the semiconductor or the thermal history of the semiconductor. This is because the doping or thermal history will result in more or less free carriers, thus affecting heating systems which rely on free carrier absorption. Since the arc lamp spectra output has sufficient energy for the band gap of the semiconductor, it does not depend on free carrier absorption.

The dimensions of the ar lamp are matched to the particular wafer being heated. Preferably, the distance between electrode tips 30 is greater than the maximum dimension of the semiconductor wafer. For a 6 inch wafer, this distance will be 8 inches. In one embodiment, the length of electrodes 22 is approximately 2.2 inches, the length of support 18 is approximately 1.9 inches and members 24 are approximately 182 of an inch. The diameter of support 18 is approximately 0.34 inches.

The lamp is constructed to give a power density in the range of 4 to 6 kilowatts per inch (KW/inch) so that the semiconductor can be raised to the required process temperatures, typically in the range of 350° C. to 1300° C. Conventional prior art arc lamps operate at power densities of approximately 1 KW/inch. To achieve this high power density, the lamp is designed with an increased diameter metal electrode 22. This diameter is preferably approximately 0.250 inches. Electrodes 22 contain a low work function metal, such as thorium oxide, to increase the electron emission. Gas capillary 22 is thin between electrode tips 30 to provide for improved heat dissipation to the water flowing through water jacket 28. Preferably, the thickness or the glass electrode is approximately ½ millimeter (mm) in this range. The remainder of the glass capillary has a thickness of approximately 1 mm.

Arc lamp 10 is provided with a dead space around member 24. The gas in this area is connected to the gas between electrode tips 30 through a small space between electrodes 22 and glass capillary 26. This space allows the heated gases to escape into the dead space around member 22 when high power is applied to the lamp. This escape valve mechanism allows the thin quartz between the electrodes to be used. Otherwise, at high power a thick quartz would be required to contain the highly heated gases, and the thick quartz would degradate the heat dissipation. At high temperatures, electrodes 22 will expand until they come in contact with capillary tube 26, thereby cutting off the escape access of gases into the dead space around members 24. At this point, however, the pressure in the mid portion of the glass capillary has been sufficiently reduced to prevent the thin quartz from being shattered.

This change in pressure also effects the power density of the lamp, which depends upon the voltage and current between electrodes 22. The RMS voltage drop in the arc lamp was fitted by the formula, $$V = A^{*}I^{b*}P^{c*}S/di \qquad (1.1)$$

where I is the rms current in amps., S is the interelectrode spacing in cm, P is the effective fill pressure of gas in atm., di is the inside bore diameter in cm, V is in volts and A is a constant in units of volts/amps $^{b*}$atm$^{c}$. Formulas of this type have appeared in the literature and its simplicity recommends it applicability. A range of variations in I, S and P for xenon gas were tested, but the bore diameter was not tested. The data were fitted by a linear regression technique and resulted in the values given in table 1. It is reasonable to expect that the parameters A, B and C have weak dependencies upon both current density and gas pressure which do not show up in the range of variation of these quantities.

The volume of the gas between the electrodes and the tube wall is negligible compared to the hot arc and the cold volume behind the electrodes. The cold volume behind the electrode of these lamps operates at the water temperature which is very close to room temperature and thus xenon gas is driven from the very hot arc region and tends to collect in the cold regions behind the electrodes. The average density of xenon atoms $N_a$ in the hot arc volume is reduced from the fill density $N_f$ according to the relation;

$$\text{where } N_a = R^* N_f \quad (1.2)$$

$$R = V^* T_c / (V_c^* T_a + V_a^* T_c) \quad (1.3)$$

Here V, $V_a$ and $V_c$ are the overall lamp, arc and cold volumes respectively, while $T_a$ and $T_c$ are the arc and cold volume temperature, respectively. In effect, the lamp fill pressure which is effective in contributing atoms to the hot arc stream is reduced from the actual fill pressure value $P_f$ by the relation;

$$P_a = R^* P_f \quad (1.4)$$

If a lamp lacks a cold reservoir the effective and actual fill pressure will be identical. Note that $P_a$ is not the operating gas pressure which normally is substantially higher than the gas fill pressure at room temperature.

The overall heat conduction loss from the arc and electrodes was measured from the temperature rise of the cooling water circulating through the lamp jacket. The temperature rise was typically 22° to 34° C. It is estimated that the uncertainty in percentage of the input power absorbed by the cooling water is ±10%.

This conduction loss is large, varying from 30% to 45% of the input power. Because of this large amount of heat transferred from lamp (arc +electrodes) to the cooling water the temperature gradient across the quartz envelope is very substantial. $I \pm P_i$ is the power lost by heat conduction across the quartz envelope, the temperature gradient for quartz will be;

$$DT = P_i^* t / A^* k \quad (1.5)$$

where t is the quartz thickness and A is the envelope area available for heat transfer. The values $k = 2.1^* 10^{-2}$ watts/cm were used for the average high temperature thermal conductivity of quartz, and it was found that DT is approximately 120° C. per Kw of thermal power transported across the 1.0 mm thick quartz envelope for 20 cm arc length and inside bore diameter of 0.7 cm. Thus, assuming a uniform heat transfer across the quartz envelope, 10 Kw of heat will result in 1200° C. temperature drop for the quartz envelope.

The current/voltage characteristic will be derived for an arc plasma whose input power is channeled completely into recombination radiation and whose electrical resistivity is determined by electron-atom collisions. A reasonable correction for additional power losses will then be made. Recombination produces a continuum which is identified with that observed in xenon. If the plasma emissivity is low, there will be very little reabsorption of the continuum. That assumption is made and its correctness will be verified later.

The derivation will be begun by equating the input power per unit volume to the recombination radiation power per unit volume;

$$J^* E = H^* n^{2*} T^{0.3} \quad (2.1)$$

Here n is the electron density, T is the electron temperature in eV, J is the current density, E is the electrical field and H is a recombination constant equal to $2.07 \times 10^{-31}$ watts cc/eV$^{0.3}$. It is assumed that fractional ionization of the gas is small enough so that the electron resistivity is controlled by collisions with the xenon gas atoms. Hence, $$E/J = D^* T^{5/2} (N/n) \quad (2.2)$$

where $D = 2.90^* 10^{-4}$ ohm cm/eV$^{2.5}$ and N is the atom density. If $p = P_a$ is the active fill pressure at 300° K, $N = 2.44.10^{19} P_a$. The electron density is finally related to the electron temperature through the Saha equation;

$$n^2 = GNT^{3/2} \exp(-U/T) \quad (2.3)$$

with $G = 3.0^* 10^{21}$ in cm $^{-3}$eV$^{-3/2}$ and U as the ionization energy of xenon, 12.12 eV.

Eq. (2.2) can be solved for n, which is substituted into Eq. (2.1) and then Eq. (2.3) is used to obtain the electric field:

$$E = (HD^{2/1/3} N^{2/3} J^{1/3} T^{1.77} \quad (2.4)$$

The electron temperature is determined from the Saha equation and Eq. (2.4), $$T = U/\ln(GD^{-2/3} H^{2/3} N^{1/3} j^{-4/3} T^{0.003}) \quad (2.5)$$

In the logarithm the slight dependence on T can be neglected especially since T will have values in the vicinity of 1 eV.

The voltage drop V across the plasma is E*S and the lamp current I is $\pi(d/r)^2 J$, if the cylindrical plasma is uniform across the lamp cross section. Substituting the values for the various constants, expressing gas density in terms of fill pressure and neglecting the weak electron temperature dependence in the logarithm provides the explicit dependence of lamp, voltage and plasma temperature upon current, tube diameter and fill pressure:

$$V = 2.37 s p^{2/3} I^{2/3} d_{-2/3} T^{1.77} \quad (2.6)$$

$$T = 12.12/\ln(5.0^* 10^9 p^{1/3} d^{8/3} I^{-4/3}). \quad (2.7)$$

Here V is in volts, I is in amps, T is in eV, p is in atmospheres fill pressure at 300° K), d and s are in cm.

The logarithm is a very slowly varying function of p, d and I and can be well approximated by a power law. It is desired to approximate $Ln^w (Au^v)$ by $Bu^2$ near $u = u_o$ in a smooth manner. To accomplish this, the logarithm is equated to the power term at $u_o$ and then slopes of the logarithm and the power terms are matched at $u_o$. This procedure determines the multiplying factor B and equivalent power z as:

$$z = vw/\ln(Au_o^v) \quad (2.8)$$

$$B = (\ln^w (Au_o^v v))(U_o^z). \quad (2.9)$$

Experiments show that the pressure varies about 1.5 atmospheres, the current about 50 amps and the tube diameter is 0.7 cm. Using these values for $P_o$, $I_o$ and $d_o$, respectively, and w = 1.77, it is found that $z_p$, $z_j$ and $z_d$ are −0.04, 0.14 and −0.29 in the expression for the electric field. The same matching procedure is adapted for the plasma electron temperature and finally results as:

$$V = 1.29 p^{0.62} I^{0.47} d^{-0.95} s \quad (2.10)$$

$$T = 0.51 p^{-0.02} I^{0.08} d^{-0.16} \quad (2.11)$$

Note that the exponent on d in the voltage expression differs slightly from the value −1 assumed in Eq. 1.1.

Table 1 compares the experimental values, at moderate current densities, of A and the power exponents with these calculations.

TABLE 1

| | A | B | C |
|---|---|---|---|
| 1. Our data: | | | |
| $p = p_f$ | 1.74 ± 0.15 | 0.40 ± 0.03 | 0.29 ± 0.05 |
| $p = p_a$ | 2.51 ± 0.20 | 0.40 ± 0.03 | 0.23 ± 0.04 |
| 2. Calculated (Elec-atom, rad rec) | 1.29 | 0.47 | 0.62 |

It is possible to account for the presence of other losses in a semi-empirical manner. Conduction and other losses will increase the power consumption of the plasma, but this effect by can be simulated by increasing the recombination coefficient H to account for the total energy loss. Thus, the first step is to introduce $H' = fH$ where f is greater than unity. From Eq. 2.4, E is then increased directly by the multiplier $f^{\frac{1}{3}}$ and indirectly by a minor amount through the dependence of E on plasma temperature which decreases slightly with an increase in H. The increase in E and in V then can be incorporated by an increase in A. As an example, if the recombination radiation is 60% of the total input power, then $f = 1.67$ and the decrease in T is 1.4%, while A increases from 1.29 to 1.53. There is, of course, no necessity that the functional dependence of the other losses on n, N and T match the functional dependence of recombination on these quantities. Thus, other losses may alter the values of b and c as well. At this stage it cannot be said whether these alterations will take the recombination values of b and c in the direction of the experimental values.

Reflector 16 of FIG. 1 is designed to get the maximum benefit from the light emitted from long arc lamp 10. The shape of reflector 16 in the direction going in and out of the page is parallel to the lamp which goes in and out of the page. The reflector thus has a semi-cylindrical shape.

To take advantage of the spectral output and power density of the long arc lamp, which was specifically developed for the rapid thermal processing of silicon, the photon flux from the linear optical source must be redistributed to provide for uniform heating of a semiconductor wafer. There are three important components of radiant energy that must be accounted for in order to achieve a flux that provides for a uniform wafer temperature: first order radiation; second order radiation; and a lambertion term. The first order radiation is that which arrives at the plane of the wafer directly from the lamp or after one reflection from a surface; i.e., either the primary reflector surface or the chamber surface. Not all the flux that arrives at the wafer plane is absorbed, however, due to the reflectivity of the silicon itself. The second order radiation accounts for the light which is reflected back into the primary reflector and then back onto the plane of the wafer. As the wafer heats up to incandescence, it becomes a second source of optical radiation which will be reflected off the primary reflector and chamber surfaces back on the wafer and can be reabsorbed. This is the third component, the lambertion term, which must be accounted for in the design of the optical cavity/-process chamber.

An optical ray trace computer program was used to account for these three sources of radiation and this computer modeling capability has been used to design the process chamber for uniform wafer heating. The computer simulation was run iteratively, adjusting the shape of the primary reflector to give a uniform flux distribution.

The information from this computer model was then used to fabricate a primary reflector with the optimized shape. This shape is shown in FIG. 1. Rapid thermal processes performed with this reflector confirm that the results predicted by the model are achieved.

As will be understood by those familiar with the art, the present invention may be embodied in other specific forms without departing from the spirit or essential characteristics thereof. For example, instead of using just xenon gas, a combination of xenon and krypton might be used. According, the disclosure of the preferred embodiment of the invention is intended to be illustrative, but not limiting, of the scope of the invention as set forth in the following claims.

What is claimed is:

1. A long arc lamp for heating a semiconductor wafer, comprising:

a pair of spaced electrodes;

a transparent casing enclosing said electrodes and the space between said electrodes; and a volume of gas enclosed within said casing and having a peak light emission wavelength with an energy greater than an energy band gap of said semiconductor wafer;

said electrodes having first and second ends with the first ends facing each other, said casing enclosing a pair of spaces adjacent respective second ends of said electrodes, said casing defining a gap between said casing and said electrodes to allow the passage of said gas between said pair of spaces and an area between said electrodes at low temperatures, said electrodes being expandable at high temperature to close said gap.

2. A long arc lamp for heating a semiconductor wafer, comprising:

a pair of electrodes separated by a distance greater than a largest dimension of said semiconductor wafer, said electrodes having first ends facing each other and second ends;

a transparent quartz casing enclosing said electrodes and the space between said electrodes, said casing enclosing a pair of spaces adjacent to respective second ends of said electrodes, there being a gap between said casings and said electrodes at low temperatures, said electrodes being expandable at high temperature to close said gap, said transparent quartz casing having a smaller thickness in a portion between said electrodes;

a quantity of gas enclosed within said casing, said gas having a peak light emission wavelength with an energy greater than an energy band gap of said semiconductor wafer; and a transparent jacket surrounding said casing for passing a coolant between said casing and said jacket to cool said arc lamp.

3. The arc lamp of claim 2, wherein said electrodes are made of thoriated tungsten.

4. The long arc lamp of claim 2, wherein said gas is xenon.

* * * * *